US009981769B2

(12) United States Patent
Ponti

(10) Patent No.: US 9,981,769 B2
(45) Date of Patent: May 29, 2018

(54) CARTON FOR PACKING AND A METHOD FOR PACKING ARTICLES USING THE PACKING CARTON

(71) Applicant: F.L. AUTO S.r.l., Rome (RM) (IT)

(72) Inventor: Giuseppe Ponti, Cerbara-Città di Castello (IT)

(73) Assignee: F.L. AUTO S.r.L., Rome (RM) (IT)

( * ) Notice: Subject to any disclaimer, the term of this patent is extended or adjusted under 35 U.S.C. 154(b) by 490 days.

(21) Appl. No.: 14/423,942

(22) PCT Filed: Aug. 27, 2013

(86) PCT No.: PCT/IB2013/058014
§ 371 (c)(1),
(2) Date: Feb. 25, 2015

(87) PCT Pub. No.: WO2014/033624
PCT Pub. Date: Mar. 6, 2014

(65) Prior Publication Data

US 2015/0225110 A1 Aug. 13, 2015

(30) Foreign Application Priority Data

Aug. 31, 2012 (IT) ..... BO2012A0462

(51) Int. Cl.

| | |
|---|---|
| ***B65D 5/02*** | (2006.01) |
| ***B65D 5/50*** | (2006.01) |
| ***B65B 5/02*** | (2006.01) |
| ***B65D 5/20*** | (2006.01) |
| ***B65D 5/44*** | (2006.01) |

(52) U.S. Cl.
CPC ..... *B65D 5/0281* (2013.01); *B65B 5/024* (2013.01); *B65D 5/20* (2013.01); *B65D 5/2095* (2013.01); *B65D 5/443* (2013.01); *B65D 5/5014* (2013.01)

(58) Field of Classification Search
CPC ..... B65D 5/20; B65D 5/2095; B65D 5/443; B65D 5/5014; B65B 5/24
USPC ..... 53/456
See application file for complete search history.

(56) References Cited

U.S. PATENT DOCUMENTS

| | | | | |
|---|---|---|---|---|
| 4,006,854 A | | 2/1977 | Gibson et al. | |
| 4,300,679 A | * | 11/1981 | Benzschawel | B65D 5/0245 206/424 |
| 4,319,710 A | | 3/1982 | Osborne | |
| 7,891,541 B2 | * | 2/2011 | Mittelstaedt | B65D 5/22 229/117.16 |

* cited by examiner

*Primary Examiner* — Robert Long
*Assistant Examiner* — Xavier A Madison
(74) *Attorney, Agent, or Firm* — R. Neil Sudol; Henry D. Coleman

(57) ABSTRACT

The invention relates to a carton for packing and a method for packing articles. The carton for packing comprises: a central portion (2) which is strip-shaped and in turn comprises a first portion (51), a second portion (52) and a third portion (53); a first reinforcing wing (11) foldable towards the second portion (52); a second reinforcing wing (12) foldable towards the second portion (52); a third reinforcing wing (13) foldable towards the third portion (53); a fourth reinforcing portion (14), foldable towards the first portion (51), a first closing wing (41) foldable towards the first portion (51); a second closing wing (42) foldable towards the first portion (51).

10 Claims, 6 Drawing Sheets

CARTON FOR PACKING AND A METHOD FOR PACKING ARTICLES USING THE PACKING CARTON

FIELD OF INVENTION

The present invention relates to the technical sector relating to packing of articles, such as books, dvd packs, reams of paper and the like. In particular the invention relates to a carton for packing and a method for packing articles using the carton for packing.

DESCRIPTION OF THE PRIOR ART

A carton of known type comprises a central portion formed by: a first wall which defines a front face of the carton; a second wall which is hinged to the first wall by means of a first crease line and defines a first flank of the carton; a third wall which is hinged to the second wall by means of a second crease line and has the same dimensions as the first wall and defines the rear face of the carton; and a fourth wall which is hinged to the third wall by means of a third crease line and defines a second flank of the carton, opposite the first flank of the carton.

Further, each wall of the central portion is provided, at two opposite ends thereof, with closing wings of the carton.

To pack an article with the above-cited carton first it is necessary to fix, for example using glue, the free end of the first wall to the free end of the fourth wall so that the central portion assumes the shape of a parallelepiped and subsequently realizes a bottom by folding and sealing the four closing wings arranged at a same end of the parallelepiped thus obtained; after which the article is inserted together with filler material (e.g. polystyrene) which absorbs possible impacts of the article during transport and finally the remaining four closing wings are closed and sealed.

A carton of this type has a low resistance to impacts and can therefore be damaged during transport, which can also lead to damage of the article contained therein. To improve the resistance to impacts of the carton, more rigid cartons can be used, which however incur greater costs.

SUMMARY OF THE INVENTION

The aim of the present invention consists in overcoming this drawback.

The above aim has been attained with a carton for packing according to claim 1, and a method for packing articles according to claim 11.

The carton for packing and the method for packing articles according to the invention advantageously offer an improved protection at least at the flanks of the article which is packed: in fact, the first superposing group and the second superposing group exhibit at least two layers of carton for packing which function as a covering of the first flank and the second flank of the article resting on the first portion; in detail, the first flank of the article is protected by an internal layer that in each section thereof can be made up of the first reinforcing wing or the second reinforcing wing or by the superposing of the first reinforcing wing and the second reinforcing wing on one another, as well as by an external layer constituted by the second portion; in a similar way, the second flank of the article is protected by an internal layer that in each section thereof can be made up by the third reinforcing wing or the fourth reinforcing wing or the superposing of the third reinforcing wing and the fourth reinforcing wing on one another, as well as by an external layer constituted by the third portion.

To further increase the degree of protection of the flanks of the article to be packed, the length of the first reinforcing wing, the second reinforcing wing, the third reinforcing wing and the fourth reinforcing wing can be selected so that the first reinforcing wing and the second reinforcing wing superpose completely on one another and the third reinforcing wing and the fourth reinforcing wing completely superpose on one another. In this case, the first superposing group and the second superposing group will each comprise three layers of carton for respectively protecting the first flank and the second flank of the carton.

Further, a better protection can be obtained also for the upper side (100) of the article to be packed, by selecting the length of the second portion and the third portion so that the second portion and the third portion can contact one another and at least partially superpose when the first superposing group and the second superposing group respectively wrap the first flank and the second flank of the article; additionally or alternatively to this condition, it is possible to dimension the carton for packing so that the first closing wing and the second closing wing contact one another, partially superposing on one another when they are folded towards the first portion with the aim of covering the upper side (100) of the article.

BRIEF DESCRIPTION OF THE DRAWINGS

Specific embodiments of the invention will be described in the following part of the present description, in accordance with what is set down in the claims and with the aid of the accompanying tables of drawings, in which:

DESCRIPTION OF PREFERRED EMBODIMENTS

Figures 1, 1A:
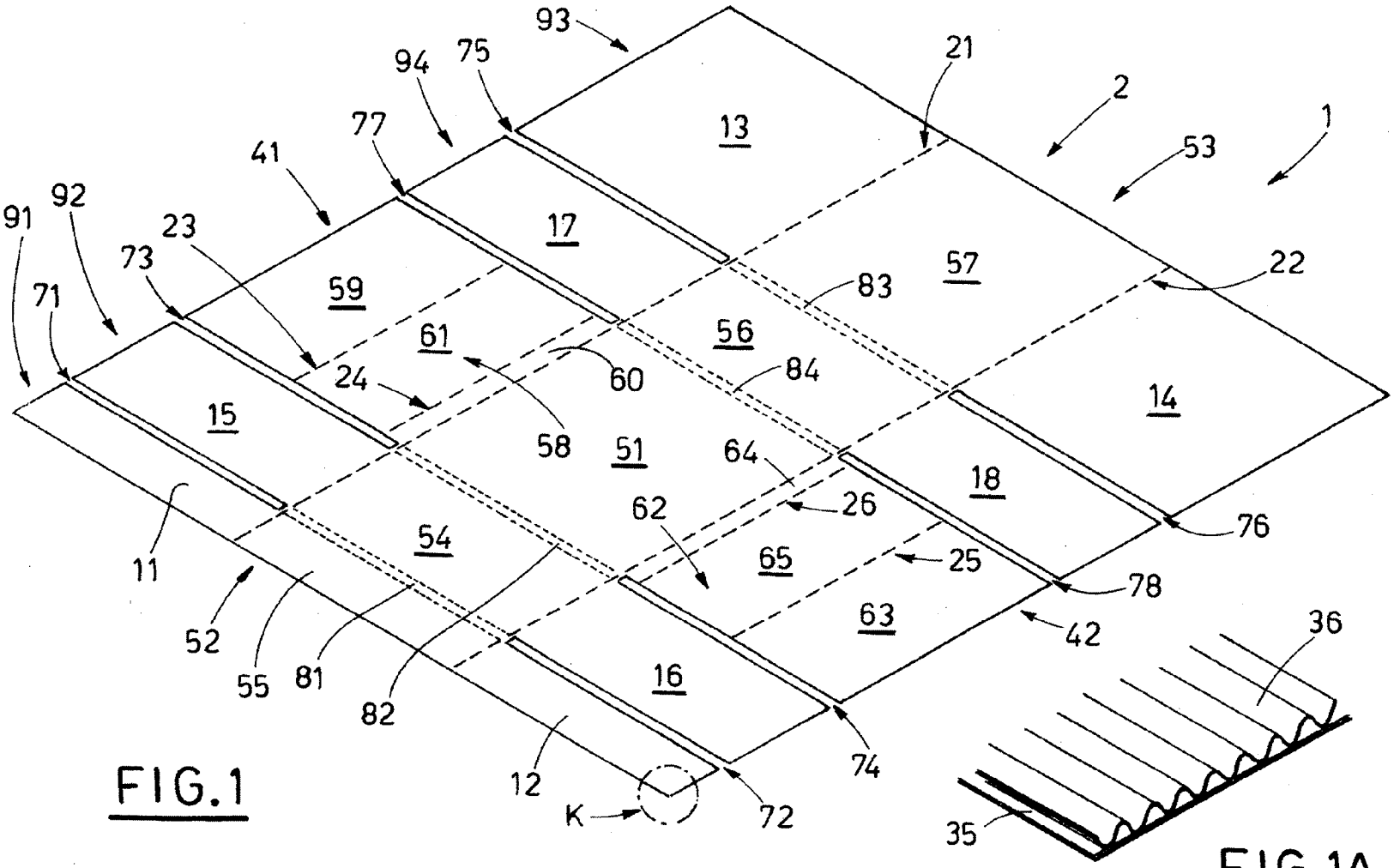
FIG. 1 is a perspective view which illustrates a first carton for packing in a flattened configuration, object of the present invention.
FIG. 1A is a larger-scale view of the detail K of FIG. 1.

With reference to the accompanying tables of drawings, (1) denotes the carton for packing in a flat configuration object of the present invention, which comprises a central portion (2) which is strip-shaped and in turn comprises a first portion (51), a second portion (52) and a third portion (53); the first portion (51) being interposed between the second portion (52) and the third portion (53) and being dimensioned such as to restingly receive at least an article (6) to be packed; the second portion (52) being dimensioned such as to wrap the article (6) at least at a first flank (7) of the article (6); the third portion (53) being dimensioned such as to wrap the article (6) at least at a second flank (6) of the article (6) which is opposite the first flank (7) of the article (6).

The carton is provided with a first crease line (21) and a second crease line (22).

The carton (1) further comprises: a first reinforcing wing (11) that is hinged to a first end of the second portion (52) by means of the first crease line (21), which first reinforcing wing (11) is foldable towards the second portion (52); and a second reinforcing wing (12) which is hinged to a second end of the second portion (52) by means of the second crease line (22), which second reinforcing wing (12) is foldable towards the second portion (52).

The first end of the second portion (52) and the second end of the second portion (52) are opposite one another.

The first reinforcing wing (11) and the second reinforcing wing (12) are preferably dimensioned such that when they are folded towards the second portion (52), they contact one another and superpose one another at least partly.

The second portion (52), the first reinforcing wing (11) and the second reinforcing wing (12) when they are all reciprocally superposed define a first superposing group (31) which is foldable such as to wrap at least the first flank (7) of the article (6) when the article (6) is resting on the first portion (51).

The carton (1) further comprises: a third reinforcing wing (13) which is hinged to a first end of the third portion (53) by the first crease line (21), which third reinforcing wing (13) is foldable towards the third portion (53); and a fourth reinforcing wing (14) which is hinged to a second end of the third portion (53) by the second crease line (22), which fourth reinforcing wing (14) is foldable towards the third portion (53).

The first end of the third portion (53) and the second end of the third portion (53) are opposite one another.

The third reinforcing wing (13) and the fourth reinforcing wing (14) are preferably dimensioned such that when they are folded towards the third portion (53), they contact one another and superpose one another at least partly.

The third portion (53), the third reinforcing wing (13) and the fourth reinforcing wing (14), when all superposed on one another, define a second superposing group (32) which is foldable such as to wrap at least the second flank (8) of the article (6) when the article is resting on the first portion (51).

Further, the carton (1) comprises: a first closing wing (41) which is hinged to a first end of the first portion (51) by the first crease line (21), which first closing wing (41) is foldable towards the first portion (51) and is dimensioned such as to wrap the article (6) at least at a third flank (101) which is comprised between the first flank and the relative second flank; and a second closing wing (42) which is hinged to a second end of the first portion (51) by the second crease line (22), which second closing wing (42) is foldable towards the first portion (51) and is dimensioned such as to wrap the article at least at a fourth flank (102) which is opposite the relative third flank (101).

The first end of the first portion (51) and the second end of the first portion (51) are opposite one another.

The first closing wing (41) and the second closing wing (42) are preferably dimensioned so that: when the article (6) is resting on the first portion (51); and when they are folded towards the first portion (51), they contact one another and at least partially superposed.

The present invention further relates to a method for packing articles, comprising steps of:

a) using a carton (1) for packing the above-described typing a flat configuration;

b) releasing at least an article (6) on the first portion (51);

c) folding both the first reinforcing wing (11) and also the second reinforcing wing (12) towards the second portion (52) up to forming the first superposing group (31) in which the second portion (52), the first reinforcing wing (11) and the second reinforcing wing (12) are superposed on one another;

d) folding the first superposing group (31) against the article (6) such as to wrap at least the first flank (7) of the article (6);

e) folding both the third reinforcing wing (13) and the fourth reinforcing wing (14) towards the third portion (53) up to forming the second superposing group (32) in which the third portion (53), the third reinforcing wing (13) and the fourth reinforcing wing (14) are superposed on one another;

f) folding the second superposing group (32) against the article (6) such as to wrap at least the second flank (8) of the article (6);

g) folding the first closing wing (41) towards the first portion (51) such as to wrap the article (6) at least at the third flank (101);

h) folding the second closing wing (42) towards the first portion (51) such as to wrap the article (6) at least at the fourth flank (102).

The order in which steps a)-h) are carried out can be different from what is described above; for example the steps can be carried out in the following order: first steps a), b), c), e) are carried out, see FIGS. 3A, 3B, then steps d), f), see FIG. 4, and lastly steps g), h) are carried out, see FIG. 5.

The central portion (2) is preferably a continuous strip, i.e. without creases (the lines indicated in FIG. 1 which involve the central portion are only by way of example, to indicate sectors 55, 81, 54, 82, 51, 84, 56, 83, 57 which will be discussed in the following part of the description, and do not represent fold lines); this is advantageous as it enables minimizing the number of crease line to be applied to the carton (1), which reduces the realization times of the carton (1).

The carton (1) is preferably in a single piece.

The first crease line (21) and the second crease line (22) are preferably parallel to one another and parallel to the development direction of the central portion (2), which simplifies the realisation of the first crease line (21) and second crease line (22).

The central portion (2) of the carton (1) is preferably rectangular and oblong, thus having a length that is greater than the width thereof; in the following description length will be taken to mean the dimension parallel to the development of the central portion (2) and width will be taken to mean the dimension which is perpendicular to the development of the central portion (2).

The first crease line (21) and the second crease line (22) delimit the central portion (2) from the remaining parts of the carton (1), i.e. from the first reinforcing wing (11), from the second reinforcing wing (12), the third reinforcing wing (13), the fourth reinforcing wing (14), the first closing wing (41) and the second closing wing (42).

The first reinforcing wing (11) is foldable towards the second portion (52) up to contacting the second portion (52) so as to be substantially parallel thereto; likewise, the second reinforcing wing (12) is foldable towards the second portion (52) up to contacting the second portion (52) such as to be substantially parallel thereto. The first reinforcing wing (11) can be folded first so as to contact and be superposed on the second portion (52), while the second reinforcing wing (12) can be folded subsequently so as to contact the first reinforcing wing (11) and be superposed thereon and on the second portion (52), or vice versa.

Figure 3A:
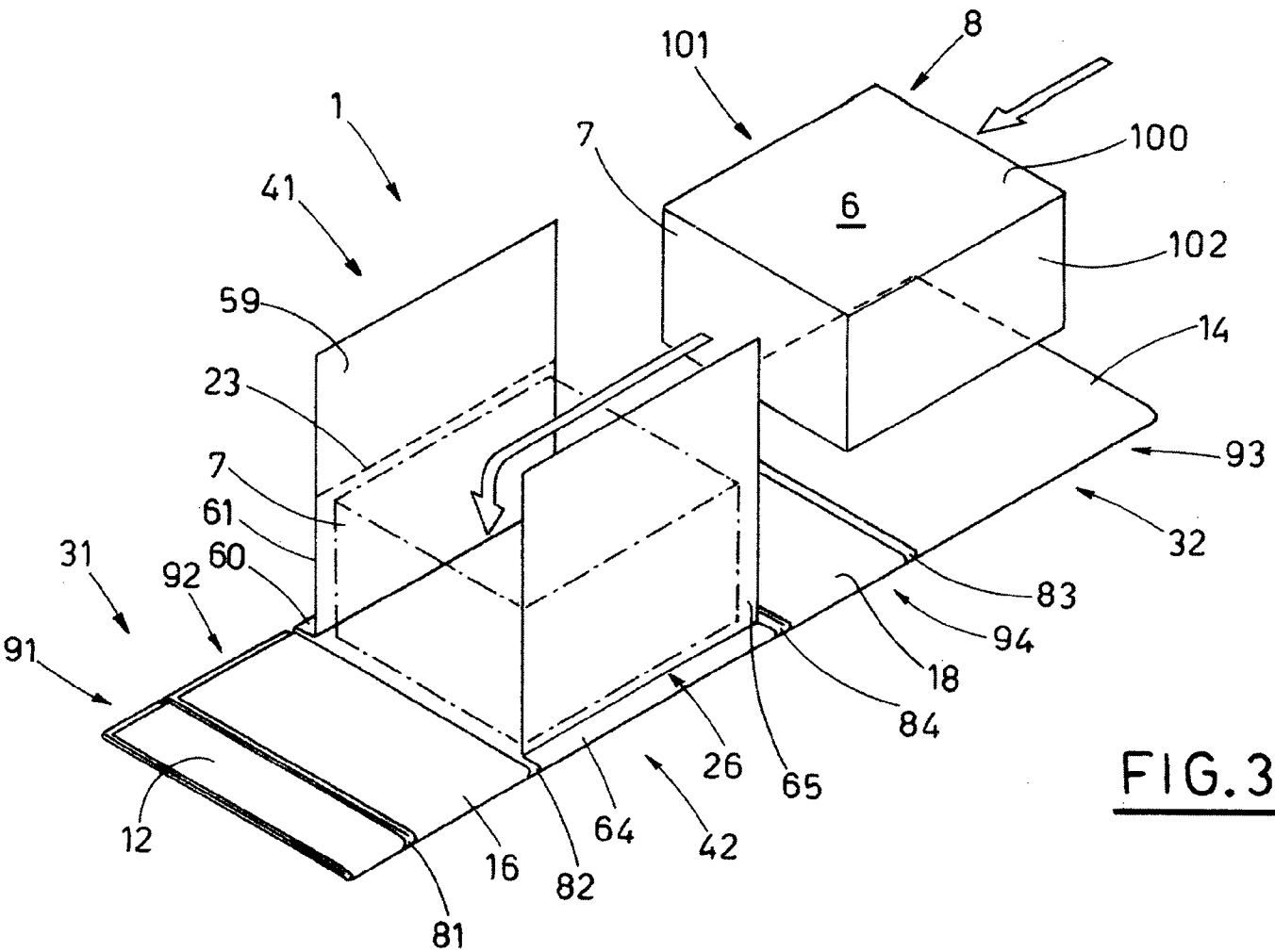
FIG. 3A is a perspective view illustrating a release of a first article to rest on the first carton for packing after the first folding step has been completed.
Figure 3B:
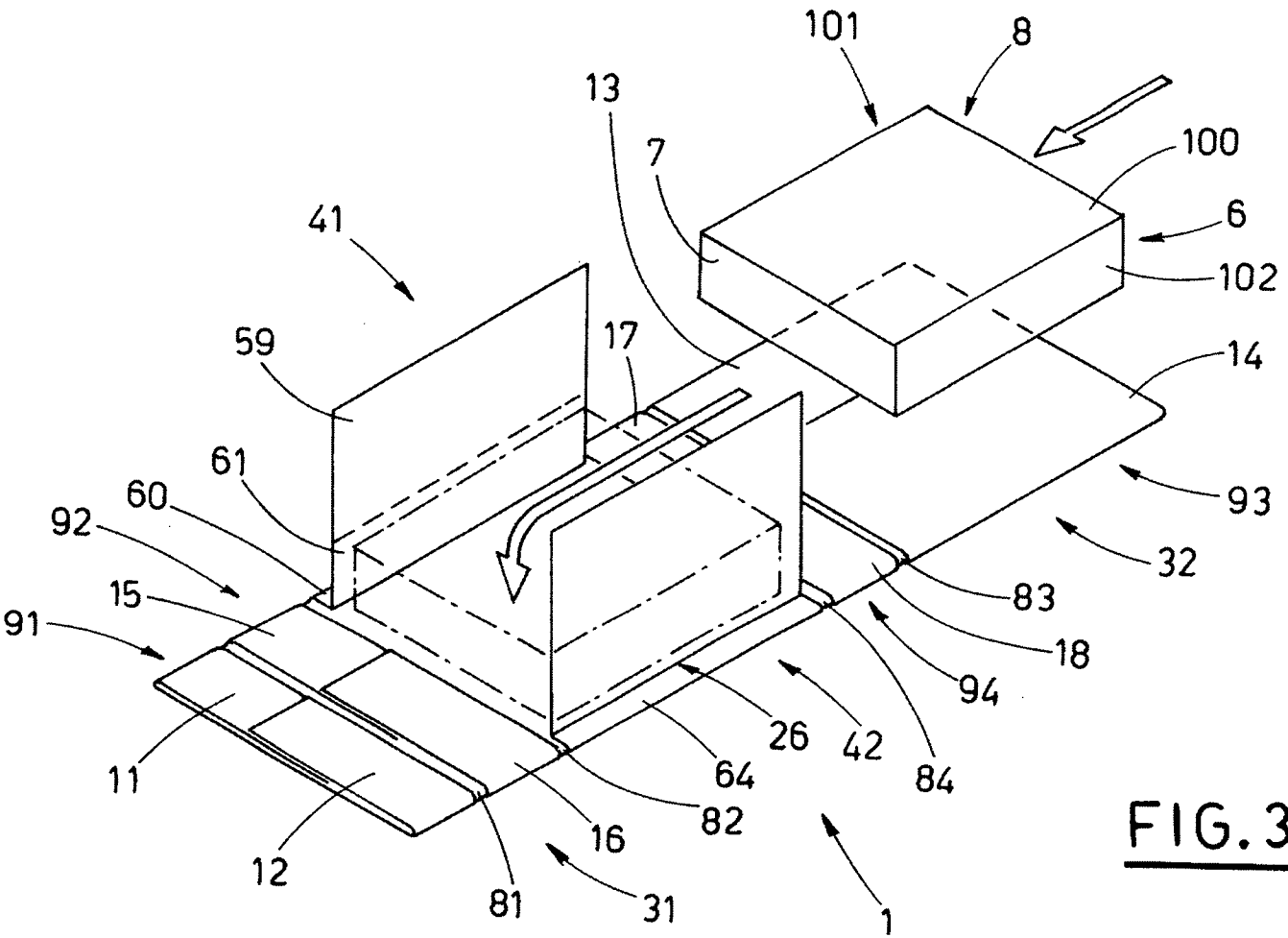
FIG. 3B is a perspective view illustrating the release of a second article to rest on a second carton for packing, also an object of the invention, after the first folding step has been completed.

The mutual superposing between the first reinforcing wing (11) and the second reinforcing wing (12) can be partial, as illustrated in FIG. 3B, or complete, as illustrated in FIG. 3A. In the present description, in general terms when referring to superposing between two elements it is meant that the superposing is at least partial.

The third reinforcing wing (13) is foldable towards the third portion (53) up to contacting the third portion (53) so as to be substantially parallel thereto; likewise, the fourth reinforcing wing (14) is foldable towards the third portion (53) up to contacting the third portion (53) so as to be substantially parallel thereto. The third reinforcing wing (13) can be folded first so as to contact and be superposed on the third portion (53), while the fourth reinforcing wing (14) can be folded subsequently so as to contact the third reinforcing wing (13) and be superposed thereon and on the third portion (53), or vice versa.

The mutual superposing between the third reinforcing wing (13) and the fourth reinforcing wing (14) can be partial, as illustrated in FIG. 3B, or complete, as illustrated in FIG. 3A.

Figure 2:
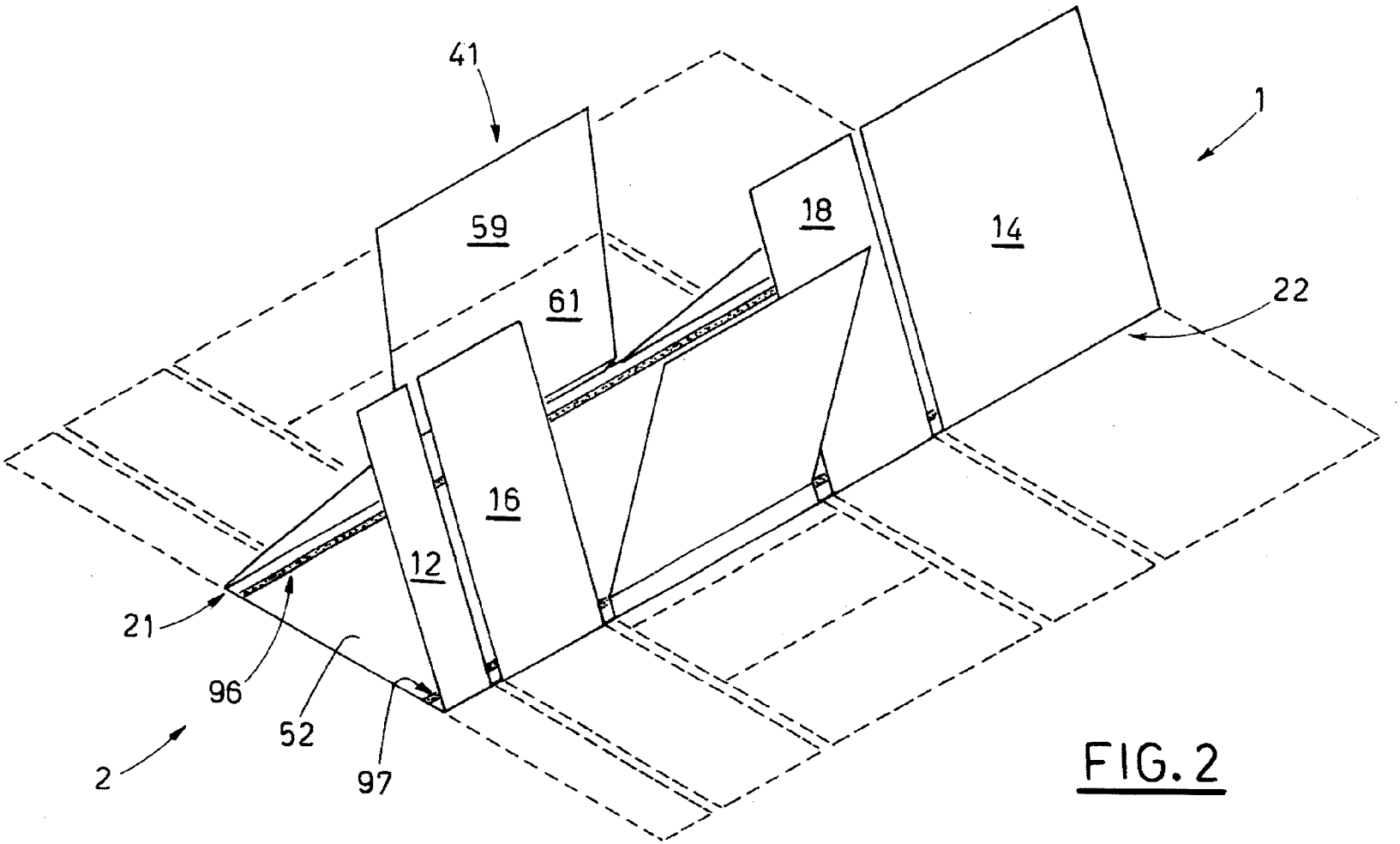
FIG. 2 is a perspective view illustrating a first folding step of the first carton for packing.

The first closing wing (41) and the second closing wing (42) can delimit the lengthwise extension of the first portion (51) (FIGS. 1, 2).

The first reinforcing wing (11) and the second reinforcing wing (12) can delimit the lengthwise extension of the second portion (52) (solution not shown in the figures): in other words, the length of the first reinforcing wing (11) and the second reinforcing wing (12) can coincide with the length of the second portion (52). Likewise, the third reinforcing wing (13) and the fourth reinforcing wing (14) can delimit the lengthwise extension of the third portion (53) (solution not shown in the figures): in other words, the length of the third reinforcing wing (13) and the fourth reinforcing wing (14) can coincide with the length of the third portion (53).

The carton (1) is preferably made up of a first sheet (35) having a planar development and a second sheet (36) having an undulating development; the first sheet (35) and the second sheet (6) are fixed to one another. The carton (1) thus-obtained advantageously exhibits good characteristics of flexibility and foldability even without recourse to additional crease lines to the first crease line (21) and the second crease line (22) (as mentioned, the central portion (2) does not require crease lines transversal to the relative longitudinal development direction); in particular, the first superposing group (31) and the second superposing group (32) can be folded respectively against the first flank (7) and the second flank (8) of the article (6) easily and without need or transversal crease lines, i.e. perpendicular to the first crease line (21) and the second crease line (22); further, also the first closing wing (41) and the second closing wing (42) can be folded against the article (6) easily, without need for additional crease lines parallel to the first crease line (21) and the second crease line (22).

Known-type cartons for packing articles use, instead, a third sheet having a planar development such that the second sheet (36) is interposed between the first sheet (35) and the third sheet. These known cartons are not foldable if not about crease lines especially provided for obtaining a box-type packing.

The carton (1) of the invention is preferably configured so that the first sheet (35) is exposed to the outside when the packing (112) of the article (6) is completed, so that the carton (1) more effectively protects the packed article (6); to obtain this, the carton (1) is designed so that the first portion (51) contacts the article (6) by means of the second sheet (36) thereof, see FIG. 1A.

The second portion (52) is preferably dimensioned so as to wrap the first flank (7) of the article (6) and to partially wrap a first part of the upper side (100) of the article (6) when the article is resting on the first portion (51); consequently, a fourth portion (54) and a fifth portion (55) are identifiable in the second portion (52), the fourth portion (54) being interposed between the first portion (51) and the fifth portion (55) and being dimensioned such as to wrap around the first flank (7) of the article (6). The first reinforcing wing (11) is preferably dimensioned and arranged to fold towards the second portion (52) and in particular superpose the fifth portion (55) (FIG. 2). The second reinforcing wing (12) is preferably dimensioned and arranged such as to fold towards the second portion (52) and superpose the fifth portion (55) (FIG. 2). The carton (1) for packing preferably comprises a fifth reinforcing wing (15) which is hinged to the first end of the second portion (52) by the first crease line (21), which fifth reinforcing wing (15) is dimensioned and arranged such as to fold towards the second portion (52) and superpose in particular the fourth portion (54). The carton (1) for packing preferably comprises a sixth reinforcing wing (16) which is hinged to the second end of the second portion (52) by the second crease line (22), which sixth reinforcing wing (16) is dimensioned and arranged such as to fold towards the second portion (52) and superpose on the fourth portion (54). The fifth reinforcing wing (15) and the sixth reinforcing wing (16), when superposed on one another and superposed on the fourth portion (54), are a part of the first superposing group (31); the second portion (52), the first reinforcing wing (11), the second reinforcing wing (12), the fifth reinforcing wing (15) and the sixth reinforcing wing (16) are configured such that when the first superposing group (31) is folded to wrap the first flank (7) of the article (6) and to partially wrap the first part of the upper side (100) of the article (6), a first group (91) formed by the fifth portion (55), the first reinforcing wing (11) and the second reinforcing wing (12) is arranged at an angle with respect to a second group (92) formed by the fourth portion (54), by the fifth reinforcing wing (15) and by the sixth reinforcing wing (16).

In accordance with the further characteristics defined for the carton (1), the method of the invention comprises: that when the first reinforcing wing (11) is folded towards the second portion (52) it superposes on the fifth portion (55); and that when the second reinforcing wing (12) is folded towards the second portion (52) it superposes on the fifth portion (55). The method comprises further steps of:

folding the fifth reinforcing wing (15) towards the second portion (52) such as to superpose on the fourth portion (54);

folding the sixth reinforcing wing (16) towards the second portion (52) such as to superpose on the fourth portion (54);

folding the first superposing group (31), comprising the second portion (52), the first reinforcing wing (11), the second reinforcing wing (12), the fifth reinforcing wing (15)

and the sixth reinforcing wing (16), against the article (6) such as to wrap the first flank (7) of the article (6) and to partially wrap the first part of the upper side (100) of the article (6) such that the group formed by the fifth portion (55), the first reinforcing wing (11) and the second reinforcing wing (12) is arranged at an angle with respect to the group formed by the fourth portion (54), by the fifth reinforcing wing (15) and by the sixth reinforcing wing (16).

The first reinforcing wing (11) and the second reinforcing wing (12) are preferably identical to one another and arranged symmetrically with respect to the central portion (2) (FIG. 1).

The fifth reinforcing wing (15) and the sixth reinforcing wing (16) are preferably identical to one another and arranged symmetrically with respect to the central portion (2) (FIG. 1).

The first reinforcing wing (11) and the fifth reinforcing wing (15) are preferably separated by a first window (71), i.e. an opening which is preferably rectangular; the second reinforcing wing (12) and the sixth reinforcing wing (16) are separated by a second window (72), i.e. an opening that is preferably rectangular. Also the first window (71) and the second window (72) are preferably positioned symmetrically with respect to the central portion (2).

The fifth reinforcing wing (15) and the first closing wing (41) are preferably separated by a third window (73), i.e. an opening which is preferably rectangular; the sixth reinforcing wing (16) and the second closing wing (42) are preferably separated by a fourth window (74), i.e. an opening that is preferably rectangular. Also the third window (73) and the fourth window (74) are preferably positioned symmetrically with respect to the central portion (2).

Consequently, when the first reinforcing wing (11) and the second reinforcing wing (12) are folded to reciprocally superpose on one another and on the fifth portion (55), and when the fifth reinforcing wing (15) and the sixth reinforcing wing (16) are folded to reciprocally superpose on one another and on the fourth portion (54), thus forming the first group, a first fold strip (81) is defined between the first group (91) and the second group (92) and a second fold strip (82) is defined between the second group (92) and the first portion (51).

The first fold strip (81) and the second fold strip (82) are perpendicular to the development direction of the central portion (2), i.e. perpendicular to the first crease line (21) and the second crease line (22).

The first fold strip (81) and the second fold strip (82) represent weakened regions of the first group, as each of them is formed only by a corresponding sector of the second portion (52) and therefore exhibits only one layer of carton (1) (see FIGS. 3A, 3B), differently to the first group (91) and the second group (92) which each exhibit at least two layers of carton (1).

The first fold strip (81) and the second fold strip (82) are thus equivalent to crease lines; in fact, when the first superposing group (31) is folded against the first flank (7) of the article (6) resting on the first portion (51), the second group (92) tends to rotate about the second fold strip (82) and the first group (91) tends to rotate with respect to the second group (92) about the first fold strip (81). In practice, in order to make the rotation of the first group (91) possible with respect to the second group (92) it is particularly preferable for the fifth reinforcing wing (15) and the sixth reinforcing wing (16) to have a length (i.e. a longitudinal extension in the development direction of the central portion 2) which is greater than or equal to (preferable equal to) the height of the first flank (7) of the article (6) to be packed.

The folding operations of the first group against the first flank (7) of the article (6) are thus advantageously facilitated.

The third portion (53) is preferably dimensioned such as to wrap the second flank (8) of the article (6) and partially wrap a second part of the upper side (100) of the article (6) when the article (6) is resting on the first portion (51). Consequently, a sixth portion (56) and a seventh portion (57) are identifiable in the third portion (53), the sixth portion (56) being interposed between the first portion (51) and the seventh portion (57) and being dimensioned such as to wrap the second flank (8) of the article (6). The third reinforcing wing (13) is preferably dimensioned and arranged such as to fold against the third portion (53) and superpose on the seventh portion (57) (FIG. 2); preferably the fourth reinforcing wing (14) is dimensioned and arranged so as to fold towards the third portion (53) and superpose in particular on the seventh portion (57) (FIG. 2). The carton for packing (1) preferably comprises a seventh reinforcing wing (17) which is hinged to the first end of the third portion (53) by means of the first crease line (21), which seventh reinforcing wing (17) is dimensioned and arranged to as to fold towards the third portion (53) and superpose on the sixth portion (56). The carton (1) for wrapping preferably comprises an eighth reinforcing wing (18) which is hinged to the second end of the third portion (53) by the second crease line (22), which eighth reinforcing wing (18) is dimensioned and arranged such as to fold towards the third portion (53) and superpose on the sixth portion (56). The seventh reinforcing wing (17) and the eighth reinforcing wing (18), when superposed on one another and superposed on the sixth portion (56) are a part of the second superposing group (32); the third portion (53), the third reinforcing wing (13), the fourth reinforcing wing (14), the seventh reinforcing wing (17) and the eighth reinforcing wing (18) being configured such that when the second superposing group (32) is folded to wrap the second flank (8) of the article (6) and to partially wrap the second part of the supper side (100) of the article (6), a third group (93) formed by the seventh portion (57), the third reinforcing wing (13) and the fourth reinforcing wing (14) is arranged at an angle preferably of 90° with respect to a fourth group (94) formed by the sixth portion (56), the seventh reinforcing wing (17) and the eighth reinforcing wing (18).

The method of the invention comprises, according to the further characteristics defined for the carton (1): that when the third reinforcing wing (13) is folded towards the third portion (53) it superposes on the seventh portion (57); and when the fourth reinforcing wing (14) is folded towards the third portion (53) it superposes on the seventh portion (57). The method comprises further steps of:

folding the seventh reinforcing wing (17) towards the third portion (53) such as to superpose on the sixth portion (56);

folding the eighth reinforcing wing (18) towards the third portion (53) such as to superpose on the sixth portion (56);

folding the second superposing group (32), comprising the third portion (53), the third reinforcing wing (13), the fourth reinforcing wing (14), the seventh reinforcing wing (17) and the eighth reinforcing wing (18) against the article (6) such as to wrap the second flank (8) of the article (6) and to partially wrap the second part of the upper side (100) of the article (6) such that the group formed by the seventh portion (57), the third reinforcing wing (13) and the fourth reinforcing wing (14) is arranged at an angle with respect to the group formed by the sixth portion (56), by the seventh reinforcing wing (17) and by the eighth reinforcing wing (18).

The third reinforcing wing (13) and the fourth reinforcing wing (14) are preferably identical to one another and arranged symmetrically with respect to the central portion (2) (FIG. 1).

The second reinforcing wing (17) and the eighth reinforcing wing (18) are preferably identical to one another and arranged symmetrically with respect to the central portion (2) (FIG. 1).

The third reinforcing wing (13) and the seventh reinforcing wing (17) are preferably separated by a fifth window (75), i.e. an opening which is preferably rectangular; the fourth reinforcing wing (14) and the eighth reinforcing wing (18) are preferably separated by a sixth window (76), i.e. an opening that is preferably rectangular. Also the fifth window (75) and the sixth window (76) are preferably positioned symmetrically with respect to the central portion (2).

The seventh reinforcing wing (17) and the first closing wing (41) are preferably separated by a seventh window (77), i.e. an opening which is preferably rectangular; the eighth reinforcing wing (14) and the second reinforcing wing (18) are preferably separated by an eighth window (78), i.e. an opening that is preferably rectangular. Also the seventh window (77) and the eighth window (78) are preferably positioned symmetrically with respect to the central portion (2).

Consequently, when the third reinforcing wing (13) and the fourth reinforcing wing (14) are folded to reciprocally superpose on one another and on the seventh portion (57), and when the seventh reinforcing wing (17) and the eighth reinforcing wing (18) are folded to reciprocally superpose on one another and on the sixth portion (56), thus forming the second group, a third folding strip (83) is defined between the third group (93) and the fourth group (94) and a fourth folding strip (84) is defined between the fourth group (94) and the first portion (51).

The third folding strip (83) and the fourth folding strip (84) are perpendicular to the development direction of the central portion (2), i.e. perpendicular to the first crease line (21) and the second crease line (22).

The third folding strip (83) and the fourth folding strip (84) represent weakened regions of the second group, as each of them is formed only by a corresponding sector of the third portion (53) and thus exhibits one only layer of carton (1) (see FIGS. 3A, 3B), differently to the third group (93) and the fourth group (94) which each exhibit at least two layers of carton (1).

The third fold line (83) and the fourth fold line (84) are therefore equivalent to crease lines; in fact, when the second superposing group (32) is folded against the second flank (8) of the article (6) resting on the first portion (51), the fourth group (94) tends to rotate about the fourth fold strip (84) and the third group (93) tends to rotate with respect to the fourth group (94) about the third fold strip (83).

In practice, in order to make the rotation of the third group (93) possible with respect to the fourth group (94) it is particularly preferable for the seventh reinforcing wing (17) and the eighth reinforcing wing (18) to have a length that is greater than or equal to (preferably equal to) the height of the second flank (8) of the article (6) to be packed.

The operations of folding the second group against the second flank (8) of the article (6) are thus advantageously facilitated.

The second portion (52) and the third portion (53) are preferably dimensioned such that when they wrap the article (6) resting in the third portion (51) they partially reciprocally superpose; in other words, the first group and the second group contact and partially superpose on one another when they are folded respectively against the first flank (7) and the second flank (8) of the article (6) resting on the first portion (51). This means that the first part of the upper side (100) of the article (6) and second part of the upper side (100) of the article (6) have an area in common.

In other words the carton (1) for packing can be dimensioned so that the upper side (100) of the article (6), opposite the relative bottom which is in contact with the first portion (51), is covered by the reciprocal superposing of the first superposing group (31) and the second superposing group (32) and/or the reciprocal superposing of the first closing wing (41) and the second closing wing (42).

Alternatively, the carton (1) for packing can be dimensioned so that the upper side (100) of the article (6) is uncovered; this can be useful if it is desired that the upper side (100) of the article (6) remains in view even after the packing of the article is completed.

The first closing wing (41) is preferably provided with a third crease line (23), which divides the first closing wing (41) into an eighth portion (58), comprised between the first crease line (21) and the third crease line (23), and a ninth portion (59) comprised between the third crease line (23) and the free end of the first closing wing (41), the first closing wing (41) being foldable towards the first portion (51) such that the ninth portion (59) is arranged at an angle with respect to the eighth portion (58).

Figure 5:
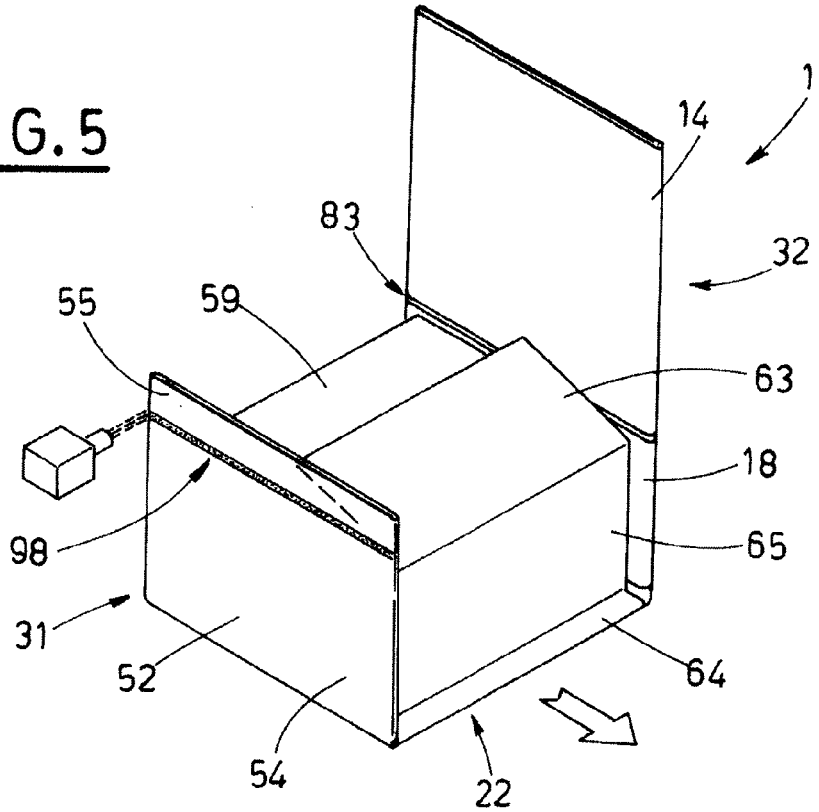
FIG. 5 is a perspective view illustrating application of glue on a portion of the first carton for packing after a third step of folding of the first carton for packing has been completed.

The first closing wing (41) is preferably provided with a fourth crease line (24) comprised between the first crease line (21) and the third crease line (23), which fourth crease line (24) divides the eighth portion (58) into a tenth portion (60), comprised between the first crease line (21) and the fourth crease line (24), and into an eleventh portion (61), comprised between the fourth crease line (24) and the third crease line (23), the first closing wing (41) being foldable towards the first portion (51) such that: the tenth portion (60) contacts the first portion (51), the eleventh portion (61) is arranged at an angle with respect to the tenth portion (60) and the ninth portion (59) is arranged at an angle with respect to the eleventh portion (61 (FIG. 5).

Thus, the tenth portion (60) superposes on the first portion (51), being arranged parallel thereto and forming a first reinforced edge (FIGS. 3A, 3B) which further protects the article (6), once the packing (112) has been completed, from impacts and accidental falls.

In accordance with the above-cited method, and in accordance with the further characteristics defined for the carton (1), the step of folding the first closing wing (41) towards the first portion (51) is done in such a way that: the tenth portion (60) contacts the first portion (51), the eleventh portion (61) is arranged at an angle (preferably 90°) with respect to the tenth portion (60) and the ninth portion (59) is arranged at an angle (preferably 90°) with respect to the eleventh portion (61).

The second closing wing (42) is preferably provided with a fifth crease line (25), which divides the second closing wing (42) into a twelfth portion (62), comprised between the second crease line (22) and the fifth crease line (25), and a thirteenth portion (63) comprised between the fifth crease line (25) and the free end of the second closing wing (42), the second closing wing (42) being foldable towards the first portion (51) in such a way that the thirteenth portion (63) is arranged at an angle with respect to the twelfth portion (62) (FIG. 5).

The second closing wing (42) is preferably provided with a sixth crease line (26) comprised between the second crease line (22) and the fifth crease line (25), which sixth crease line (26) divides the twelfth portion (62) into a fourteenth portion (64) comprised between the second crease line (22) and the sixth crease line (26), and into a fifteenth portion (65), comprised between the sixth crease line (26) and the fifth crease line (25), the second closing wing (42) being foldable towards the first portion (51) such that: the fourteenth portion (64) contacts the first portion (51), the fifteenth portion (65) is arranged at an angle with respect to the fourteenth portion (64) and the thirteenth portion (63) is arranged at an angle with respect to the fifteenth portion (65).

Thus, the fourteenth portion (64) superposes on the first portion (51), being arranged parallel thereto and forming a second reinforced edge (FIGS. 3A, 3B) which advantageously protects the article (6), once the packing (112) has been completed, from impacts and accidental falls.

In accordance with the above-cited method, and according to the further characteristics defined for the carton (1), the step of folding the second closing wing (42) towards the first portion (51) is done in such a way that: the fourteenth portion (64) contacts the first portion (51), the fifteenth portion (65) is arranged at an angle with respect to the fourteenth portion (64) and the thirteenth portion (63) is arranged at an angle with respect to the fifteenth portion (65).

FIG. 2 illustrates two strips of glue applied on the central portion (2), i.e: a first strip of glue (96) arranged in proximity of the first crease line (21) and parallel thereto; and a second strip of glue (97) which is arranged in proximity of the second crease line (22) and parallel thereto.

The first strip of glue (96) is arranged, with respect to the first crease line (21) so as to make the fixing possible: from the second reinforcing wing (12) to the fifth portion (55); from the sixth reinforcing wing (16) to the fourth portion (54); from the fourteenth portion (64) to the first portion (51); from the eighth reinforcing wing (18) to the sixth portion (56); and from the fourth reinforcing wing (14) to the seventh portion (57).

The second strip of glue (97) is arranged, with respect to the seconds crease line (22) so as to make the fixing possible: from the first reinforcing wing (11) to the fifth portion (55); from the fifth reinforcing wing (15) to the fourth portion (54); from the tenth portion (60) to the first portion (51); from the seventh reinforcing wing (17) to the sixth portion (56); and from the third reinforcing wing (13) to the seventh portion (57).

FIGS. 3A, 3B clarify how it is possible to pack articles (6) of different dimensions (in the illustrated case of two articles they are of different height) by adapting the measurements of the carton (1) of the present invention.

Figure 4:
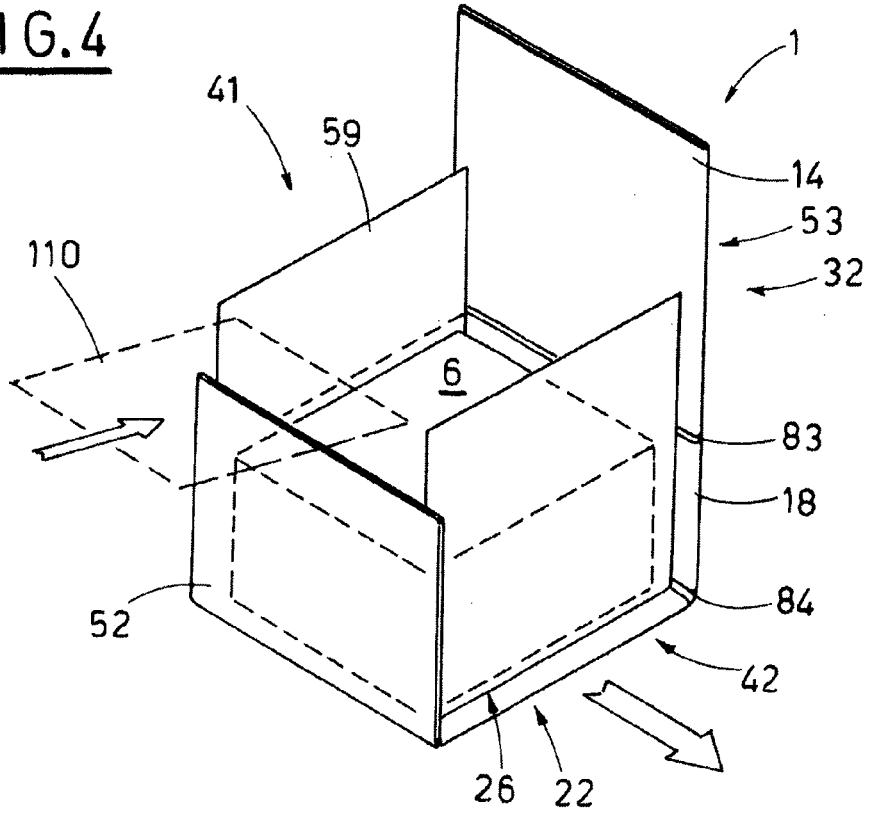
FIG. 4 is a perspective view illustrating the release of a document to rest on the upper side of the first article after a second folding step of the first carton for packing has been completed.

FIG. 4 illustrates the step of inserting a document (110) into the packing in formation, before a packing operation is completed.

Figure 6:
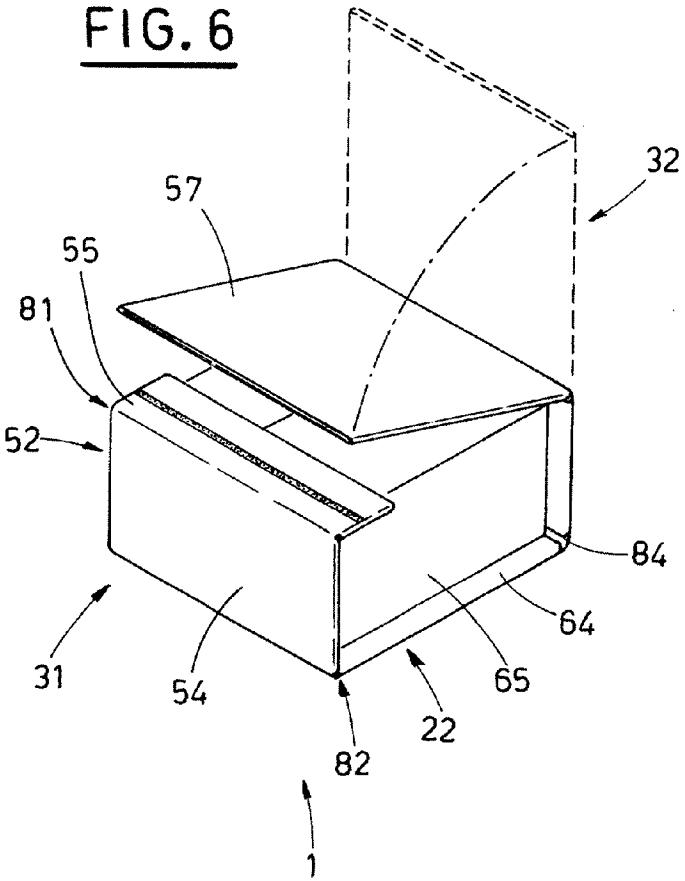
FIG. 6 is a perspective view illustrating a fourth folding step of the first carton for packing so as to obtain a sealed packing containing the first article.

FIG. 5, by way of example, illustrates an application of a third strip of glue (98) on the first group (91), which third strip of glue (98) in particular contacts the fifth portion (55) so as to ensure sealing of the packing (112) (FIG. 6) once all the folding operations of the carton (1) have been carried out.

Figure 7A:
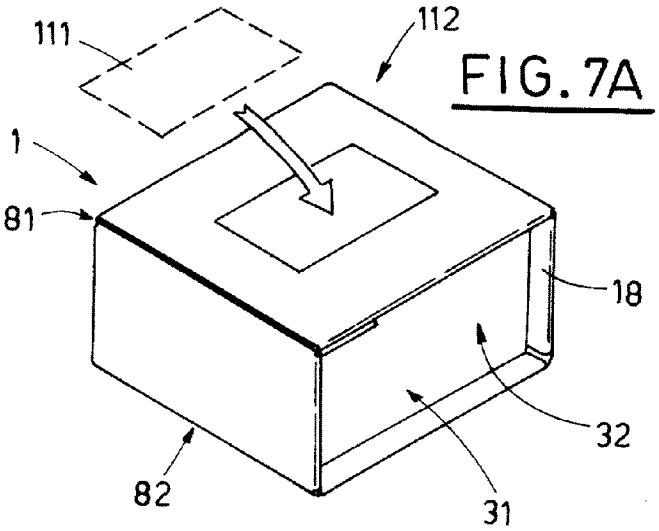
FIG. 7A is a perspective view illustrating the packing after the fourth folding step has been completed, and illustrates application of a label.
Figure 7B:
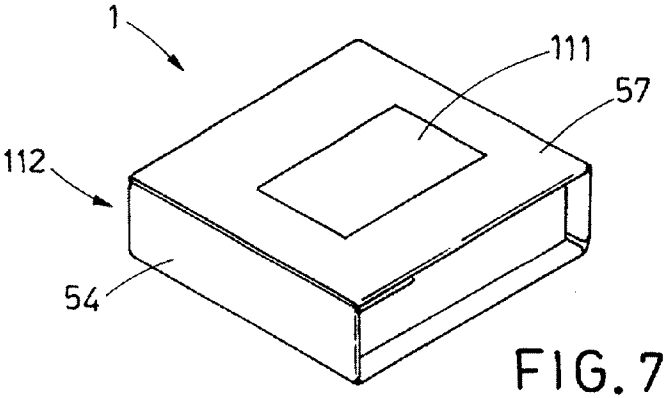
FIG. 7B is a similar view to that of FIG. 7A, from which it differs in that the packing contains the second article of FIG. 3B and has been obtained by using the second carton for packing of FIG. 3B.

FIGS. 7A, 7B show packings (112) suitable for articles of different dimensions and a step of applying a label (111) to the packing (112).

The above has been described by way of non-limiting example, and any constructional variants are understood to fall within the protective scope of the present technical solution, as claimed in the following.

The invention claimed is:

1. A carton for packing, comprising: a central portion which is strip-shaped and in turn comprises a first portion, a second portion and a third portion; the first portion being interposed between the second portion and the third portion and being dimensioned to restingly receive at least an article to be packing packed; the second portion being dimensioned to wrap the article at least at a first flank of the article; the third portion being dimensioned to wrap the article at least at a second flank of the article which is opposite the first flank of the article; a first crease line and a second crease line; a first reinforcing wing that is hinged to a first end of the second portion by means of the first crease line, which first reinforcing wing is foldable towards the second portion; a second reinforcing wing which is hinged to a second end of the second portion by means of the second crease line, which second reinforcing wing is foldable towards the second portion, the first end of the second portion and the second end of the second portion being opposite one another, the second portion, the first reinforcing wing and the second reinforcing wing when they are all reciprocally superposed defining a first superposing group which is foldable to wrap at least the first flank of the, article when the article is resting on the first portion; a third reinforcing wing which is hinged to a first end of the third portion by the first crease line which third reinforcing wing is foldable towards the third portion; a fourth reinforcing wing which is hinged to a second end of the third portion by the second crease line, which fourth reinforcing wing is foldable towards the third portion; the first end of the third portion and the second end of the third portion are opposite one another, the third portion, the third reinforcing wing and the fourth reinforcing wing, when all superposed on one another, define a second superposing group which is foldable to wrap at least the second flank of the article when the article is resting on the first portion; a first closing wing which is hinged to a first end of the first portion by the first crease line, which first closing wing is foldable towards the first portion and is dimensioned to wrap the article at least at a third flank which is comprised between the first flank and the second flank; a second closing wing which is hinged to a second end of the first portion by the second crease line, which second closing wing is foldable towards the first portion and is dimensioned to wrap the article at least at a fourth flank which is opposite the third flank, the first end of the first portion and the second end of the first portion being opposite one another, wherein the first closing wing is provided with a third crease line, which divides the first closing wing into an eighth portion, comprised between the first crease line and the third crease line, and a ninth portion comprised between the third crease line and the free end of the first closing wing, the first closing wing being foldable towards the first portion such that the ninth portion is arranged at an angle with respect to the eighth portion, and wherein the first closing wing is provided with a fourth crease line comprised between the first crease line and the third crease line, which fourth crease line divides the eighth portion into a tenth portion, comprises between the first crease line and the fourth crease line, and into an eleventh portion, comprised between the fourth crease line and the third crease line, the first closing wing being foldable towards the first portion such that: the tenth portion contacts the first portion, the eleventh portion is arranged at an angle with respect to the tenth portion and the ninth portion is arranged at an angle with respect to the eleventh portion.

2. The carton for packing of claim 1, wherein the second portion is dimensioned for wrapping the first flank of the article and for partially wrapping a first part of the upper side of the article when the article is resting on the first portion, a fourth portion and a fifth portion being identifiable in the second portion, the fourth portion being interposed between the first portion and the fifth portion and being dimensioned to wrap the first flank of the article; wherein the first reinforcing wing is dimensioned and arranged to fold towards the second portion and superpose the fifth portion wherein the second reinforcing wing is dimensioned and arranged to fold towards the second portion and superpose the fifth portion; the carton for packing comprising a fifth reinforcing wing which is hinged to the first end of the second portion, by the first crease line, which fifth reinforcing wing is dimensioned and arranged to fold towards the second portion and superpose the fourth portion; the carton for packing comprising a sixth reinforcing wing which is hinged to the second end of the second portion by the second crease line, which sixth reinforcing wing is dimensioned and arranged to fold towards the second portion and superpose on the fourth portion; the fifth reinforcing wing and the sixth reinforcing wing, when superposed on one another and superposed on the fourth portion being a part of the first superposing group; the second portion, the first reinforcing wing, the second reinforcing wing, the fifth reinforcing wing and the sixth reinforcing wing being configured such that when the first superposing group is folded to wrap the first flank of the article and to partially wrap the first part of the upper side of the article, a first group formed by the fifth portion, the first reinforcing wing and the second reinforcing wing is arranged at an angle with respect to a second group formed by the fourth portion, by the fifth reinforcing wing and by the sixth reinforcing wing.

3. The carton for packing of claim 2, wherein the third portion is dimensioned to wrap the second flank of the article and partially wrap a second part of the upper side of the article when the article is resting on the first portion, a sixth portion and a seventh portion being identifiable in the third portion, the sixth portion being interposed between the first portion and the seventh portion and being dimensioned to wrap the second flank of the article; wherein the third reinforcing wing is dimensioned and arranged to fold against the third portion and superpose on the seventh portion; wherein the fourth reinforcing wing is dimensioned and arranged to fold towards the third portion and superpose on the seventh portion; the carton for wrapping comprising a seventh reinforcing wing which is hinged to the first end of the third portion by the first crease line, which seventh reinforcing wing is dimensioned and arranged to fold towards the third portion and superpose on the sixth portion; the carton for wrapping comprising an eighth reinforcing wing which is hinged to the second end of the third portion by the second crease line, which eighth reinforcing wing is dimensioned and arranged to fold towards the third portion and superpose on the sixth portion; the seventh reinforcing wing and the eighth reinforcing wing, when superposed on one another and superposed on the sixth portion, being a part of the second superposing group; the third portion, the third reinforcing wing, the fourth reinforcing wing, the seventh reinforcing wing and the eighth reinforcing wing being configured such that when the second superposing group is folded to wrap the second flank of the article and to partially wrap the second part of the supper side of the article, a third group formed by the seventh portion, the third reinforcing wing and the fourth reinforcing wing is arranged at an angle with respect to a fourth group formed by the sixth portion, the seventh reinforcing wing and the eighth reinforcing wing.

4. The carton for packing of claim 1, wherein the second portion and the third portion are dimensioned such that when they wrap the article resting in the third portion they partially reciprocally superpose.

5. The carton for packing of claim 1 wherein the second closing wing is provided with a fifth crease line, which divides the second closing wing into a twelfth portion, comprised between the second crease line and the fifth crease line, and a thirteenth portion comprised between the fifth crease line and the free end of the second closing wing, the second closing wing being foldable towards the first portion in such a way that the thirteenth portion is arranged at an angle with respect to the twelfth portion.

6. A method for packing articles, steps comprising: using a carton for packing according to claim 3; releasing at least an article on the first portion; folding both the first reinforcing wing and also the second reinforcing wing towards the second portion up to forming the first superposing group in which the second portion, the first reinforcing wing and the second reinforcing wing are superposed on one another; folding the first superposing group against the article to wrap at least the first flank of the article; folding both the third reinforcing wing and the fourth reinforcing wing towards the third portion up to forming the second superposing group in which the third portion, the third reinforcing wing and the fourth reinforcing wing are superposed on one another; folding the second superposing group against the article to wrap at least the second flank of the article; folding the first closing wing towards the first portion to wrap the article at least at the third flank; folding the second closing wing towards the first portion such as to wrap the article at least at the fourth flank, wherein the first closing wing is provided with a third crease line, which divides the first closing wing into an eighth portion, comprised between the first crease line and the third crease line, and a ninth portion comprised between the third crease line and the free end of the first closing wing, the first closing wing being foldable towards the first portion such that the ninth portion is arranged at an angle with respect to the eighth portion; and wherein the first closing wino is provided with a fourth crease line comprised between the first crease line and the third crease line which fourth crease line divides the eighth portion into a tenth portion, comprises between the first crease line and the fourth crease line, and into an eleventh portion, comprised between the fourth crease line and the third crease line, the first closing wing being foldable towards the first portion such that: the tenth portion contacts the first portion, the eleventh portion is arranged at an angle with respect to the tenth portion and the ninth portion is arranged at an angle with respect to the eleventh portion, wherein the seep of folding the first closing wing towards the first portion is done such that: the tenth contacts the first portion the eleventh portion is arranged at an angle with respect to the tenth portion and the ninth portion is arranged at an angle with respect to the eleventh portion.

7. The method for packing articles of claim 6, wherein when the first reinforcing wing is folded towards the second portion it superposes on the fifth portion; wherein when the second reinforcing wing is folded towards the second portion it superposes on the fifth portion; the method comprising further steps of: folding the fifth reinforcing wing towards the second portion to superpose on the fourth portion; folding the sixth reinforcing wing towards the second portion to superpose on the fourth portion; folding the first superposing group, comprising the second portion, the first reinforcing wing, the second reinforcing wing, the fifth reinforcing wing and the sixth reinforcing wing, against the article to wrap the first flank of the article and to partially wrap the first part of the upper side of the article such that the group formed by the fifth portion, the first reinforcing wing and the second reinforcing wing is arranged at an angle with respect to the group formed by the fourth portion, by the fifth reinforcing wing and by the sixth reinforcing wing.

8. The method for packing articles of claim 6, wherein when the third reinforcing wing is folded towards the third portion it superposes on the seventh portion; wherein when the fourth reinforcing wing is folded towards the third portion it superposes on the seventh portion; the method comprising further steps of: folding the seventh reinforcing wing towards the third portion to superpose on the sixth portion; folding the eighth reinforcing wing towards the third portion to superpose on the sixth portion; folding the second superposing group, comprising the third portion, the third reinforcing wing, the fourth reinforcing wing, the seventh reinforcing wing and the eighth reinforcing wing against the article to wrap the second flank of the article and to partially wrap the second part of the upper side of the article such that the group formed by the seventh portion, the third reinforcing wing and the fourth reinforcing wing is arranged at an angle with respect to the group formed by the sixth portion, by the seventh reinforcing wing and by the eighth reinforcing wing.

9. The method for packing articles of claim 6 wherein the second closing wing is provided with a fifth crease line, which divides the second closing wing into a twelfth portion, comprised between the second crease line and the fifth crease line, and a thirteenth portion comprised between the fifth crease line and the free end of the second closing wing, the second closing wing being foldable towards the first portion in such a way that the thirteenth portion is arranged at an angle with respect to the twelfth portion, wherein the second closing wing is provided with a sixth crease line comprised between the second crease line and the fifth crease line, which sixth crease line divides the twelfth portion into a fourteenth portion comprised between the second crease line and the sixth crease line, and into a fifteenth portion, comprised between the sixth crease line and the fifth crease line, the second closing wing being foldable towards the first portion such that: the fourteenth portion contacts the first portion, the fifteenth portion is arranged at an angle with respect to the fourteenth portion and the thirteenth portion is arranged at an angle with respect to the fifteenth portion, wherein the step of folding the second closing wing towards the first portion is done in such a way that: the fourteenth portion contacts the first portion, the fifteenth portion is arranged at an angle with respect to the fourteenth portion and the thirteenth portion is arranged at an angle with respect to the fifteenth portion.

10. A carton for packing, comprising:

a central portion which is strip-shaped and in turn comprises a first portion, a second portion and a third portion; the first portion being interposed between the second portion and the third portion and being dimensioned to restingly receive at least an article to be packed; the second portion being dimensioned to wrap the article at least at a first flank of the article; the third portion being dimensioned to wrap the article at least at a second flank of the article which is opposite the first flank of the article;

a first crease line and a second crease line;

a first reinforcing wing that is hinged to a first end of the second portion by means of the first crease line, which first reinforcing wing is foldable towards the second portion;

a second reinforcing wing which is hinged to a second end of the second portion by means of the second crease line, which second reinforcing wing is foldable towards the second portion;

the first end of the second portion and the second end of the second portion being opposite one another;

the first reinforcing wing and the second reinforcing wing being foldable on the second portion, the first reinforcing wing and the second reinforcing wing being dimensioned such that, when the first reinforcing wing and the second reinforcing wing are folded on the second portion, the first reinforcing wing and the second reinforcing wing contact one another and superpose one another, the second portion with the first reinforcing wing and the second reinforcing wing folded onto the second portion and superposing one another defining a first superposing group which is foldable to wrap at least the first flank of the article when the article is resting on the first portion;

a third reinforcing wing which is hinged to a first end of the third portion by the first crease line, which third reinforcing wing is foldable towards the third portion;

a fourth reinforcing wing which is hinged to a second end of the third portion by the second crease line, which fourth reinforcing wing is foldable towards the third portion;

the first end of the third portion and the second end of the third portion being opposite one another;

the third reinforcing wing and the fourth reinforcing wing being foldable on the third portion, the third reinforcing wing and the fourth reinforcing wing being dimensioned such that, when the third reinforcing wing and the fourth reinforcing wing are folded on the third portion, the third reinforcing wing and the fourth reinforcing wing contact one another and superpose one another, the third portion with the third reinforcing wing and the fourth reinforcing wing folded onto the third portion and superposed on one another, defining a second superposing group which is foldable to wrap at least the second flank of the article when the article is resting on the first portion;

a first closing wing which is hinged to a first end of the first portion by the first crease line, which first closing wing is foldable towards the first portion and is dimensioned to wrap the article at least at a third flank which is comprised between the first flank and the second flank;

a second closing wing which is hinged to a second end of the first portion by the second crease line, which second closing wing is foldable towards the first portion and is dimensioned to wrap the article at least at a fourth flank which is opposite the third flank;

the first end of the first portion and the second end of the first portion being opposite one another.

* * * * *